United States Patent [19]

Altman et al.

[11] 4,067,071

[45] Jan. 10, 1978

[54] BATHTUB, WALL AND CEILING LINER ASSEMBLY

[75] Inventors: Murray Altman, Scarsdale; Richard Altman, Bardonia; Arthur Roberts, Westbury, all of N.Y.

[73] Assignee: Thermasol Ltd., Leonia, N.J.

[21] Appl. No.: 694,555

[22] Filed: June 10, 1976

[51] Int. Cl.[2] ..... A47K 3/08; A47K 3/00

[52] U.S. Cl. ..... 4/145; 4/146; 4/148; 4/173 R

[58] Field of Search ..... 4/145, 146, 147-149, 4/151-154, 173 R, 173 M, 174, 175, 177, 185 R

[56] References Cited

U.S. PATENT DOCUMENTS

| | | | |
|---|---|---|---|
| 2,677,268 | 5/1954 | Hobbs | 4/146 X |
| 2,853,714 | 9/1958 | Darmstadt | 4/173 R |
| 3,045,254 | 7/1962 | Cook et al. | 4/173 R |
| 3,088,124 | 5/1963 | Long | 4/173 R |
| 3,593,347 | 7/1971 | Nemiroff | 4/197 |
| 3,614,793 | 10/1971 | Nemiroff | 4/173 R |
| 3,827,086 | 8/1974 | Seymour et a. | 4/175 |
| 3,931,651 | 1/1976 | Weir | 4/173 R |

*Primary Examiner*—Henry K. Artis

[57] ABSTRACT

A combination liner assembly for bathtub, walls and ceiling is provided for renovating a worn or outmoded bathtub installed in a wall recess. The assembly includes a plastic bathtub-shaped liner having a tub portion sized to be seated in the tub cavity of the bathtub with the bottom surface of the tub portion resting upon the bottom surface of the original tub cavity and said bottom surface supporting the weight of the liner as well as the water and the bather therein. The bathtub liner is connected to the waste and overflow drains of the original bathtub and has an outwardly projecting peripheral flange around the top edge thereof which overlies the marginal ledges of the bathtub. Sealing membranes provide water-tight seals between the peripheral flange of the bathtub liner and the walls of the wall recess. The assembly also includes a matching wall liner which covers the walls of the recess above the bathtub liner. The wall liner may be topped by a dome, which rests on an outwardly-extending flange.

16 Claims, 7 Drawing Figures

BATHTUB, WALL AND CEILING LINER ASSEMBLY

The present invention relates to liners for refurbishing and renovating bathtubs and shower and tub wall coves or recesses, and in particular relates to a novel and improved plastic shell for insertion as a liner in old, worn or damaged bathtubs, and installation of matching or contrasting wall panel liners for covering the walls adjacent to the bathtub.

For many years bathtubs have conventionally been made with cast iron or pressed steel bodies coated with ceramic porcelain enamel on the exposed surface. In more recent years some bathtubs have been made of organic plastic materials such as polyester reinforced with fiberglass or heavy gauge thermoformed plastics having a thermal deforming range above 185° F.

Because of their large size and heavy weight it is difficult to install bathtubs, and the installation of new bathtubs is therefore usually confined to newly-built bathrooms. The tubs are brought in before the joists and walls are erected and the bathroom is finished after the tub is set in place. However, after the bathtub has been in use for many years, it may become necessary to replace it where the porcelain has become chipped, discolored or eroded, or for purposes of renovation, or when the bathroom is to be redecorated. In such instance, to remove the old tub from the bathroom and bring in a new tub requires a major construction operation which often includes the destruction of the tile walls. Since the tubs are of large size, they usually will not fit through standard doorways. In such case, the replacement of a tub generally requires at least one wall to be removed in order to remove the old tub and bring in a new one.

Conventional bathtubs are usually installed in a recess in the bathroom normally designated a "cove," the walls of the recess being normally tiled and often matching the color of the bathtub. When the decor of the bathroom is to be changed, or the color of the walls and/or appurtenances varied, it is generally necessary not only to replace the tub, but to replace the tiles or otherwise resurface the walls of the bathtub recess, such renovations being a costly and time-consuming process.

It is an object of the present invention to eliminate the necessity of removing and replacing worn, discolored, damaged or outmoded bathtubs, by providing means for covering the visible bathtub surfaces with a liner shell formed of a durable and wear-resistant plastic presenting an attractive configuration in one or more selected colors.

Another object of the invention is the provision of a bathtub liner of the character described which is sized and constructed to prevent deforming of the liner when flexural strains are applied to its surfaces.

Another object of the invention is the provision of a bathtub liner of the type described which is preferably formed from a thermoplastic material and is assembled with the original tub in such a manner to prevent the bathtub insert from thermally deforming when the bathtub is filled with hot water and supports the weight of a person bathing therein, or from permanently flexurally deforming under any conditions of use. The bathtub liner may also be made to withstand temperatures of steam without deformation, for those instances in which the bathtub is installed in a steam environment.

Another object of the invention is the provision of a bathtub liner of the character described which may be quickly and easily installed, and which is of such size as to fit most standard bathtubs, thus eliminating the necessity of providing and stocking liners in a variety of sizes.

Still another object of the invention is the provision of a bathtub liner of the character described in combination with a matching or contrasting wall liner for covering the walls of the recess in which the bathtub is set. The wall liner is preferably made of the same plastic material as the bathtub liner, either matching or contrasting in color and textural or other surface qualities. The bathtub liner and wall liner thus combine to present a unitary modernized bathtub and adjacent recess of a desired color and design which fits over the existing bathtub and recess walls, and is installed economically without requiring major destruction or construction.

A further object of the invention is to provide a wall liner of the character described which may be easily and conveniently mounted on a wall surface, thereby eliminating the necessity of removing and replacing worn, discolored, damaged or outmoded walls, particularly tile walls.

A further object of the invention is the provision of a bathtub liner and associated wall liner, either or both of which is constructed and mounted so as to prevent leakage around the margin of the tub. The wall liner itself is constructed and assembled in such a manner as to prevent water and/or steam leakage. A dome may be associated with the wall liner to conceal the ceiling of the recess. In some instances, doors may be mounted at the front of the recess to enable the latter to serve as a steam enclosure. The wall liner is mounted on the recess walls and ceiling in such a manner to provide for adequate adhesion even in the presence of steam.

In accordance with the present invention there is provided bathtub renovating means for refurbishing an existing bathtub usually installed in a wall recess, the bathtub having a tub cavity and marginal ledges extending outwardly from the upper end of the tub cavity. The bathtub renovating means includes a bathtub liner formed of a flexible plastic material and comprising a tub portion having a bottom wall and upstanding side and end walls, and peripheral flanges extending perpendicularly outward from the top ends of said side and end walls.

The tub portion of the bathtub liner is made of lesser length and lesser width than the tub cavity of the original bathtub, and is of a height greater than the depth of the tub cavity. The bathtub liner is thus sized for insertion on said bathtub in a mounted position in which the tub portion is seated within the cavity of the original bathtub with the bottom wall of the bathtub liner resting on the floor of the original bathtub cavity, the peripheral flanges of the bathtub liner overlying the marginal ledges of the original bathtub, and the weight of the bathtub liner supported substantially solely by the bottom surface of the original tub cavity.

With the bathtub liner in mounted position, the side and end walls of the bathtub liner are usually spaced from the adjacent wall surfaces of the original tub cavity thereby defining gaps therebetween, and these gaps may be filled with a self-aligning, fluent filler material which may be fractionated material in granular form, a cellular plastic material, a highly filled epoxy resin, or the like.

A skirt may also be provided to cover the front side of the original tub with the skirt extending from one of the bathtub liner flanges to the floor surface supporting the original bathtub. Water-tight sealing means is also provided between the bathtub liner and the wall recess. The sealing means comprises flexible plastic membranes secured to the ledges of the bathtub liner and to the adjacent recess walls.

The bathtub renovating means may also include a wall liner assembly for covering the side and end walls of the wall recess above the bathtub liner. The wall liner assembly comprises a central section and a pair of side sections formed of plastic material matching or contrasting with the material of the bathtub liner.

Additional objects and advantages of the invention will become apparent in the course of the following specification when taken in connection with the accompanying drawings, in which.

Figure 2:
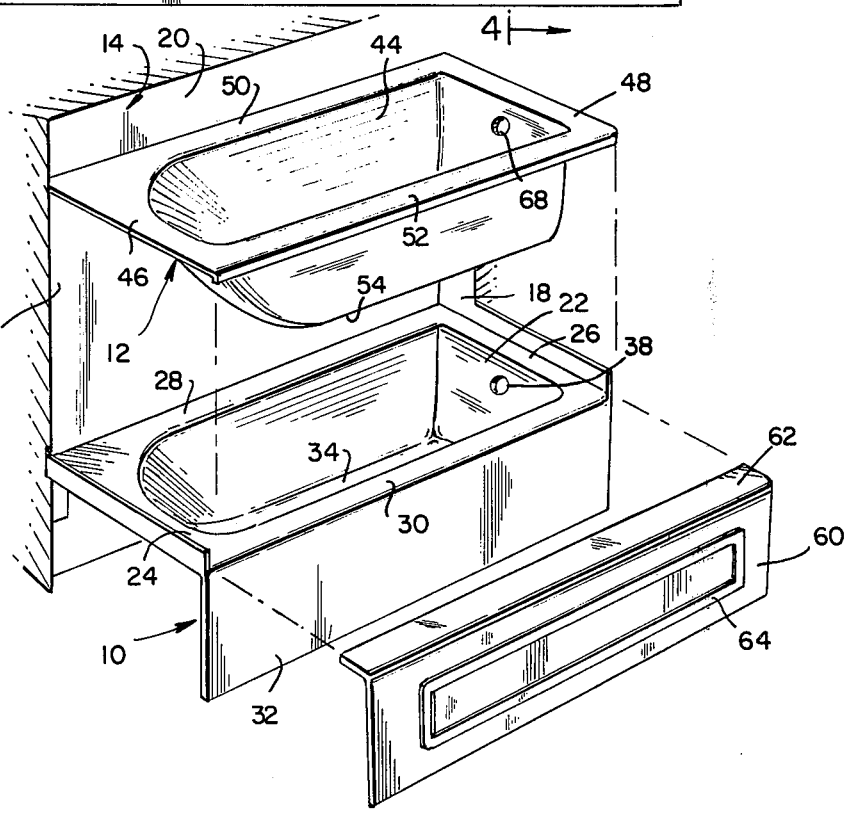
FIG. 2 is an exploded perspective view showing the manner in which the bathtub liner insert is mounted on an existing bathtub.

Referring in detail to the drawings, there is shown in FIG. 2 a conventional original bathtub 10 which is to be covered and refurbished by the bathtub liner insert 12 of the present invention. As is often typical, the bathtub 10 is installed in a bathroom recess or alcove 14 having facing end walls 16 and 18, a rear side wall 20, and an open front.

The bathtub 10 has the usual tub cavity 22 bordered by an integral horizontal ledge constituting end ledge portions 24 and 26 and side ledge portions 28 and 30. The ends of ledge portions 24, 26 and 28 are normally embedded in the walls of the bathtub recess or alcove 14, while the front side edge portion 30 faces and extends to the front open end of the recess 14 and is formed integrally with a vertical skirt 32 which extends to the bathroom floor and partially supports the tub. The bathtub 10 including the ledge portions and skirt 32, is covered with the usual porcelain enamel surface, and may be of any conventional shape and configuration.

Figure 4:
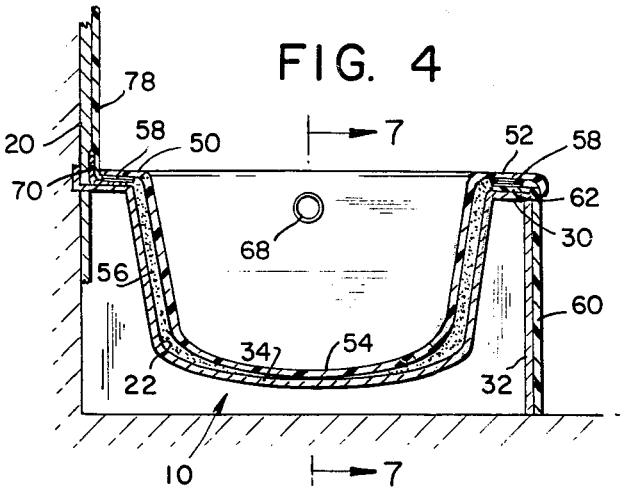
FIG. 4 is a transverse section taken along lines 4—4 of FIG. 1 and showing the bathtub liner mounted on the existing bathtub.
Figure 6:
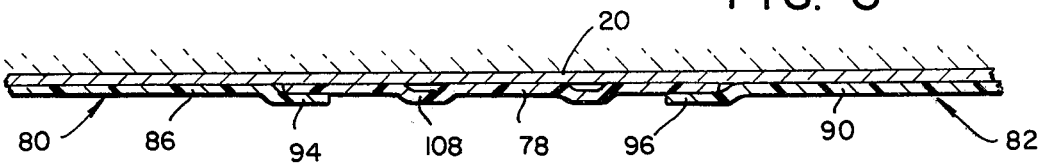
FIG. 6 is an enlarged section taken along line 6—6 of FIG. 1.
Figure 7:
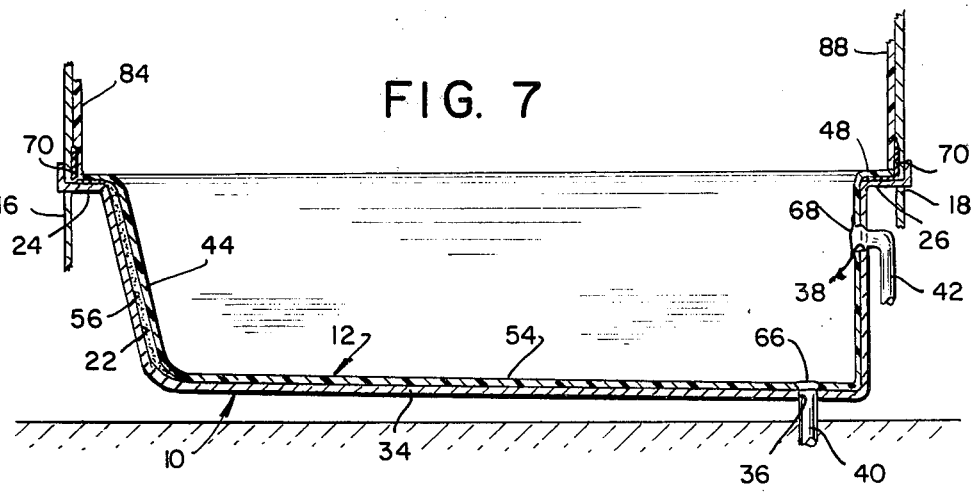
FIG. 7 is a longitudinal section taken along line 7—7 of FIG. 4.

In common with most standard bathtubs, the tub cavity 22 of the bathtub 10 has a bottom wall 34 which is of shallow concave shape in transverse cross-section as shown in FIG. 4. In addition, the bottom wall 34 is disposed to slope downwardly one to two degrees toward the outlet end thereof as shown in FIG. 7. A conventional drainage outlet opening 36 is provided at the outlet end of the bottom wall 34, and an overflow outlet opening 38 may also be formed in the end wall of tub cavity 22 above the drainage outlet opening 36. As shown in FIG. 7, the openings 36 and 38 are connected to drain pipes 40 and 42.

The bathtub liner 12 is formed of a plastic material, as will be presently described in detail, with a tub portion 44 bordered by integral horizontally-projecting peripheral end flange or ledge portions 46, 48 and side flange or ledge portions 50, 52. The tub portion 44 has a bottom wall 54 which is curved transversely to provide a concave transverse cross-section, and which slopes at a slight angle to match the downward slope of the bottom wall 34 of bathtub 10.

The liner 12 is preferably formed from a textured or smooth plastic sheet material. Examples of plastic materials having the desired properties of structural strength, resistance to wear and thermal deformation, rigidity with a slight degree of flexibility, comfort and aesthetic appeal, are polystyrene, polyethylene, polypropylene, acrylonitrile-butadiene-styrene (ABS) acrylic plastic film laminated to ABS and other thermoplastic materials. The liner may also be made of fiberglass reinforced polyester or fiberglass-reinforced epoxy resin. The thickness of these plastic sheets may vary from 50 mils to 375 mils.

Further, it is possible to make a liner from a thermally-formed flexible shell that has been rigidized by utilizing a fiberglass reinforced rigid polyester polymerized to a rigid state as a rigidizing laminate on the entire outside surface of the shell or, at least, over outside surface areas where added rigidification is needed.

In such cases as the above, a shell is formed of a material such as ABS. It is then made less flexible by coating the outside surface with fiberglass reinforced polyester. A proper adhesive must be utilized, such as acrylic lacquer or a methyl methacrylate monomer. The acrylic lacquer, such as Rohm & Hass' #101, is applied to the ABS surface and then the fiberglass reinforced polyester is sprayed over it. The acrylic lacquer provides the necessary molecular adhesion.

Where the aforementioned methyl methacrylate monomer is utilized as the adhesive, a catalyst is sprayed over the ABS, after the ABS surface has been cleaned with isopropyl alcohol. Then the methyl methacrylate monomer is applied over the catalyst and, before it polymerizes, the fiberglass reinforced polyester is applied over the methyl methacrylate monomer. In such fashion, a strong molecular adhesion is created between the ABS and the fiberglass reinforced polyester. An example of such monomer which has been found particularly effective as an adhesive is a polymerizable methyl methacrylate monomer R02491-60, and a catalyst, accelerator #4 presently distributed by Hughson chemicals, Division of Lord Corporation. This monomer and catalyst are described as "a free radical curing polymerizable modified acrylic structural adhesive."

Fiberglass reinforced polyesters have been used in the past for reinforcing shells, but previously these polyesters have been applied directly over the exterior surface of a shell thermally formed from an acrylic sheet. However, such reinforced shells presented certain problems in that acrylics are not fire retardant, have a tendency to lose impact strength over a period of time, and are quite expensive. The use of acrylic lacquers or polymerizable acrylics as adhesives between ABS and fiberglass reinforced polyester is advantageous in eliminating such problems, since ABS can be made fire resistant, holds its impact characteristics for larger periods of time, and is less costly than acrylic.

The bathtub liner 12 is designated herein as "flexible" in the sense that the plastic material designated above, when in sheet form, are bendable and can be easily flexed. When the plastic sheets are processed to form the liner insert, as by vacuum forming, molding or the like, at least some portions of the formed insert will be flexible and deformable.

To further define "flexibility" as used in this specification, it should be noted that the type of thermoplastic plastic preferred for the liners of this invention is exemplified by Uniroyal's Kralastic Flame Retardant FVM grade of ABS. This has a Flexural Modulus of $2.5\times10^5$ P.S.I. Some of the more rigid grades of ABS have flexural modulii of from $3.5\times10^5$ P.S.I. to $5\times10^5$ P.S.I.

As a still further example of the flexibility of the preferred ABS, in ⅛ inch thickness it can be coiled in a circle as small as 8 inches in original shape. Polystyrene demonstrates flexural modulus data similar to ABS.

When the abovementioned plastic materials are compared with structural steel, which has a Young's Modulus of $30\times10^6$ P.S.I., it is apparent that ABS is very flexible. Steel ⅛ inch thick could not be bent into an 8 inch diameter coil without permanently distorting it and, besides, it would take almost 100 times the force necessary to bend the ABS. As a consequence, for purposes of this specification, the plastic shells, before being supported, are defined as flexible. Rigid polyester or epoxy reinforced with fiberglass has flexural modulus of from 10 to $30\times10^5$ P.S.I. This means that it takes approximately three to 10 times the force to bend it than an equal width and thickness of ABS. Of course, it still takes a tenth of the force to bend the reinforced polyester than an equal width and thickness of steel. In this sense, even the reinforced polyester is flexible.

The tub portion 44 of bathtub liner 12 is made of a lesser length and width than the tub cavity 22 of the bathtub 10, so that it will fit easily within the latter. The liner 12 is also made of greater height than the height of the tub cavity 22. When the liner 12 is inserted within the bathtub 10, the bottom wall 54 of the liner rests directly upon the bottom wall 34 of the tub cavity 22, as shown in FIG. 4, while the side and end walls of the liner are spaced from the side and end walls of the tub cavity 22. The flange or ledge portions 46, 48, 50 and 52 of the liner 12 are also spaced a short distance above the respective ledge portions 24, 26, 28 and 30 of the bathtub 10.

However, in some installations it may happen that the cavity of the original bathtub is of such size that the liner 12 will fit exactly therewithin. In this case, the side and end walls of the liner will rest flush against the inner surfaces of the tub cavity, and the flange or ledge portions of the liner will rest flush upon the ledge portions of the original bathtub.

In installing the liner 12, it is first set in position within the bathtub 10, with the concave portion of its bottom wall 54 resting on the concave portion of the bottom wall 34 of the tub cavity 22, and the spaces between the liner 12 and the outer surfaces of the bathtub 10 may be filled with self-aligning filler materials 56. These filler materials may be, for example, 60 mesh sand, feldspar, limestone, or similar materials which are fluent when fractionated. The self-aligning filler materials may alternatively constitute plastic foam materials such as rigid or soft urethane foam. Highly filled polyesters or epoxy resins, which will set after a period of time, have also been found especially effective for this purpose. The highly filled epoxies are preferred since their shrinkages are low. An example of such epoxy composition is "Shell Epon 828," 100 parts; DTA, 11.2 parts; 325 mesh silica, 100 parts; and 60 mesh sand, 200 parts. These parts are by weight. The aforementioned highly filled epoxy composition decreases the unit cost, and also decreases shrinkage due to polymerization. It is also possible to insert rigid spacer elements manually into the spaces between the insert 12 and bathtub 10, but the use of self-aligning filler materials, as previously described, is preferred.

After the filler material is inserted, suitably sized shims 58 may be inserted in the spaces between the bathtub ledge portions 24, 26, 28, 30 and the overlying liner flange or ledge portions 46, 48, 50 and 52. These shims 58 are employed to balance the liner 12 within the tub 10 and to align the liner accurately while the filler material 56 orients itself and sets and hardens, preventing the liner from tipping or shifting position. In certain instances, where the height of the tub cavity 22 is in the range of the largest conventional tub dimension, the liner flange portions may rest directly upon the ledge portions of the bathtub, so that the use of shims is unnecessary. In either instance, however, it will be appreciated that since the bottom wall 54 of the liner 12 rests firmly upon the bottom wall 34 of the bathtub cavity 22, a major part of the weight of the liner, as well as that of the water and the bather therein, is supported by the bottom of the original tub. A small amount of this weight may be applied to the bathtub ledge portions by the overlying insert flange or ledge portions, but the bulk of the weight is sustained by the bottom of the original bathtub. This has a decided advantage over bathtub inserts wherein the insert is suspended within the tub with the insert ledges resting upon the tub ledges and the bottom of the insert spaced above the bottom of the tub. In the latter instance, the insert is subject to twisting and distortion under the weight of water and a bather. Such shifting and distortion is eliminated in the liner of the present invention where the liner weight is applied along the inner surface of the bottom wall of the bathtub cavity.

The bathtub liner 12 is made of such dimensions that it will fit properly into most conventional bathtubs which have already been installed. Thus a single liner may be fabricated for use in most standard bathtubs and it is not necessary to manufacture and stock liners in a large variety of sizes and shapes to fit varying bathtubs. In many standard bathtubs, the tub cavity is approximately 55 inches in length, about 25 inches wide, and about 14 inches in depth. Standard bathtubs are made approximately to these dimensions, although they may vary from one to another by small amounts in any dimension. The liner 12 of the instant invention is thus made narrower than the narrowest cavity width dimension encountered in standard bathtubs in the field, and shorter than the shortest cavity length dimension of such bathtubs. On the other hand, the liner 12 is made with a depth dimension greater than the largest cavity depth dimension encountered in conventional bathtubs. In a commercial embodiment of the liner 12, the portion 44 is made with inner dimensions 4 feet, 6 inches in length, 24 inches in width, and 14½inches in depth. This insures that, regardless of the size of the bathtub within standard limits, the tub body of the liner 12 will fit easily within the tub portion of the bathtub, with the bottom wall of the insert resting upon the bottom wall of the bathtub and the marginal flanges or ledges of the liner insert spaced above or lightly engaging the marginal flanges of the bathtub.

A front skirt 60, made of the same material as the liner insert 12, may be provided to complete the bathtub liner installation. The skirt 60 is formed with a top flange 62 which projects perpendicularly therefrom and is positioned to underlie or overlie the outer side flange or ledge portion 52 of the liner 12, while the bottom edge of the skirt 60 is trimmed to lie flush against the floor surface, in the manner shown in FIG. 4. The skirt 60 is securely and permanently secured to the vertical skirt 32 of the bathtub 10 by contact cement or other means, and its flange 62 is similarly secured to the underlying or overlying flange portion 30 of bathtub 10. With the skirt 60 in mounted position the liner 12 and the skirt 60 completely enclose and hide from view the previously visible portion of bathtub 10, which now serves solely as a mount and support for the insert liner. The skirt 60 may be provided with embossed or surface-applied ornamentation 64 to enhance the appearance of the liner installation.

A drain opening 66 is provided in the bottom wall 54 of liner 12 in registry with the existing drainage outlet opening 36 of the bathtub 10 and is coupled to the drain pipe 40 in the manner shown in FIG. 7. Similarly, an overflow opening may be provided in the end wall of liner insert 12 in registry with the overflow outlet opening 38 of bathtub 10, and is coupled to the drain pipe 42 in a manner which will be familiar to those skilled in the art.

Figure 5:
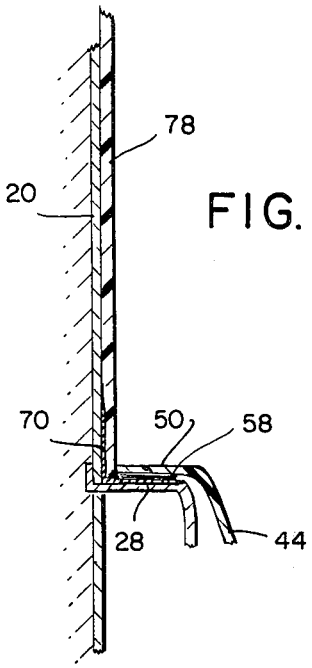
FIG. 5 is an enlarged fragmentary section corresponding to the upper left-hand portion of FIG. 4, and showing the manner in which the marginal edges of the bathtub liner insert is sealed to the walls of the bathtub recess.

The flange or ledge portions 46, 48, 50 and 52 of the liner 12 are initially fabricated of sufficient width to extend to the walls of the recess or cove in which the particular original bathtub has been installed. In installation of the liner, the flange portions are trimmed sufficiently to enable the edges thereof to lie flush along the surfaces of the recess walls 16, 18 and 20 surrounding the tub. To prevent leakage of water or steam between the recess walls and the liner insert 12, a sealing membrane 70 is provided. The membrane 70 is made of a flexible, water impervious material, for example of plasticized PVC of 4 mil thickness, and is secured by adhesion or other means to each bathtub liner ledge adjacent a recess wall, and to the adjacent wall. FIG. 5 shows one section of the membrane 70 attached by contact adhesive to the lower surface of the bathtub liner ledge 50, with its opposite end section bent upwardly and secured by contact adhesive or other means flat against the side wall 20 of the recess or alcove 14. Alternatively, the membrane 70 may be attached to the upper surface of liner ledge 50. Identical membranes 70 are similarly attached to the upper and/or lower surfaces of bathtub liner ledges 46 and 48 along the lengths of such ledges and to the surfaces of the adjacent recess end walls 16 and 18, as shown in FIG. 7, and indicated in broken line in FIG. 1. More typically, the recess walls are lined with tile, and the membranes 70 are adhered directly to these tile surfaces. The attached membranes 70 provide effective seals around the liner insert 12 and prevent water from leaking through the space between the liner insert 12 and the bathtub 10. Where the recess walls are also covered by a wall liner installation, as to be presently described, the wall liners will often cover over the membranes.

Figure 1:
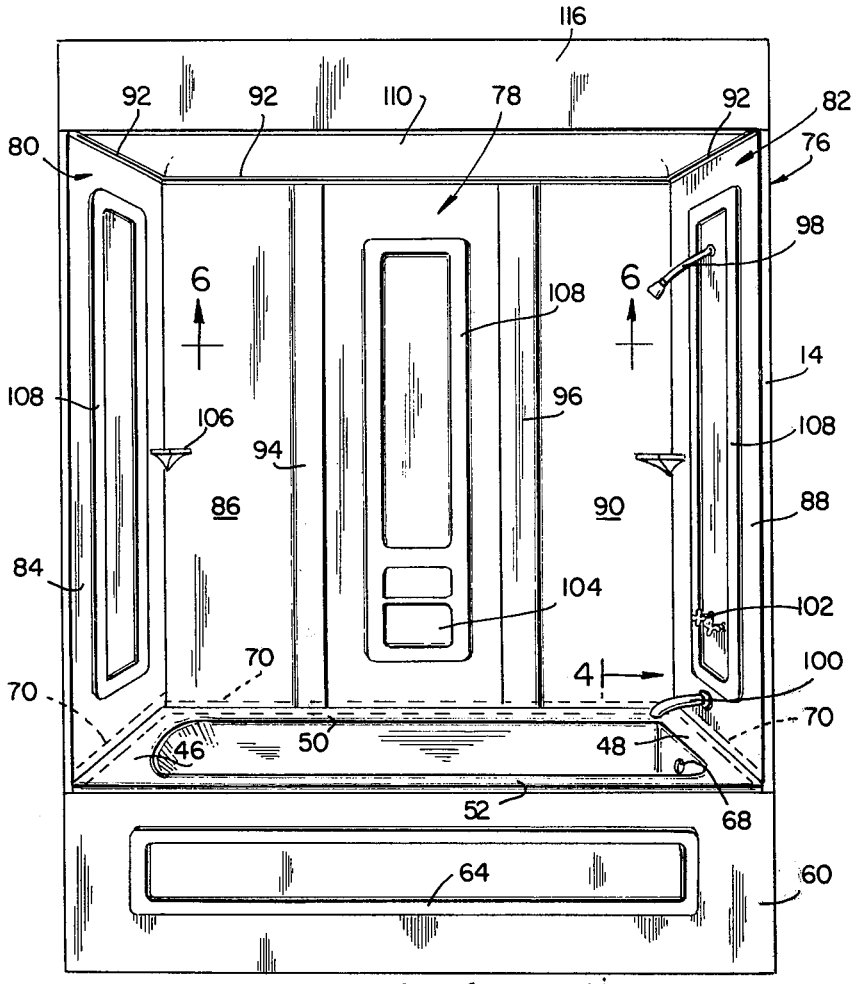
FIG. 1 is an isometric view of a bathtub recess showing a bathtub liner insert installed over an original bathtub and a wall liner and dome overlying the walls and ceiling of the recess.
Figure 3:
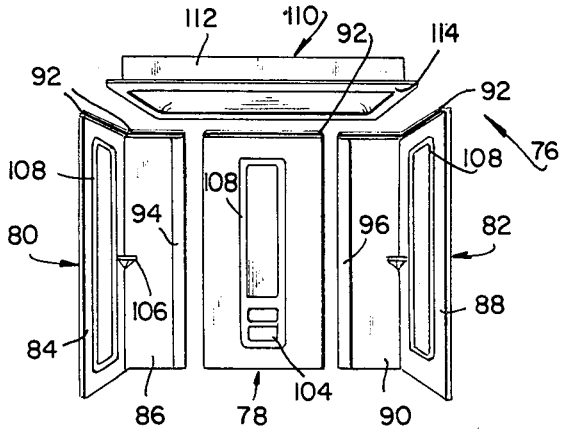
FIG. 3 is an exploded isometric view showing the wall liner and dome elements of the recess of FIG. 1.

To complete the refurbishing of the bathtub area, if desired, a wall liner and dome assembly 76, shown in FIGS. 1 and 3 may be provided. The assembly 76 includes a central wall liner section 78 preferably formed from a flat panel of flexible plastic sheet material, and two side sections 80 and 82. Each side section 80 and 82 is made angular, of L-shaped configuration, the side section 80 comprising an end panel 84 and an integral side panel 86 extending perpendicularly thereto. Similarly, the side section 82 comprises an end panel 88 and an integral side panel 90 extending perpendicularly thereto. The central section 78 and side sections 80 and 82 are each formed with top flanges 92 which project perpendicularly outward from the recess walls upon which the sections are mounted, and which serve to support the dome of the assembly. The sections are preferably made of plastic material which may match, in color and texture, the consitutent material of the liner insert 12.

After the bathtub liner 12 has been installed, the central wall liner section 78 is centered on the side wall 20 of the bathroom recess or cove, and is secured by contact adhesive or other means such as pressure sensitive adhesive, urethane adhesive, epoxy adhesive or the like, flush against the tiling which usually lines said walls, or, if no tiling is provided, directly to the side wall 20. The side section 80 is then similarly mounted with the end panel 84 adhered or otherwise attached flush against the recess end wall 16, the side panel 86 adhered or otherwise attached flush against the recess side wall 20, and the edge portion of the side panel 86 overlapping the adjacent edge portion of the mounted central section 78. In a similar manner, the opposite side section 82 is mounted with its end panel 88 flush against the recess end wall 18, its side panel 90 flush against the recess side wall 20 and the edge portion of the side panel 90 overlapping the adjacent edge portion of the mounted central section 78. The free marginal edge portions of the side panels 86 and 90 are formed with respective outwardly-stepped flanges 94 and 96 which overlie, rest flush against, and are adhered or otherwise attached to the respective edges of the central section 78, while permitting the major portions of the side panels 86 and 90 to rest flush against the recess back side wall 20.

It has been found that, by adhering the wall liners to the wall with certain non-thermally deforming adhesives, at times, a thermal expansion problem can develop where steam is used. In certain cases, where the coefficient of thermal expansion of the plastic material is great, it has been found that adhering or attaching the panels at certain selected areas tends to cut down warpage of the panels due to the expansion.

If the wall panels are adhered over the entire area of the panels, portions of the panels are liable to tear away due to thermal expansion, in spite of the adhesive, and warp.

Another way to control the effects of thermal expansion of the thermoplastic wall is to laminate fiber reinforced polyester to the rear surfaces of the panels. The polyester rigidizes the panels so that they can be placed in free standing position over the tub, allowing expansion without developing warpage that would be encountered in certain cases if the panels are attached to the walls.

The wall liner assembly 76 may be provided with suitable openings for receiving such bathtub fixtures which are available, such as a shower head mounting 98, a faucet 100 and faucet handles 102. The wall liner assembly 76 may also be conveniently molded with a recessed soap dish 104, shelves 106, or other accessory features and may also be formed with embossed molding or surface decoration 108 which may match that of the skirt 60.

The assembly 76 may also include the dome 110 shown in FIG. 3, which dome is preferably formed of the same plastic material as the wall liner sections 78, 80 and 82 so as to match the same and provide therewith a complete and unitary bathtub enclosure. The dome 110 comprises a shallow, box-like body 112 bordered by an outwardly-projecting marginal flange 114. The flange 114 overlies the flanges 92 of the wall liner sections 78, 80 and 82, and is cemented thereto by suitable adhesive means as previously described. A facia 116 may be provided to conceal the upper outer surface of the dome 110 thereby enhancing the visual appearance of the unit.

The adhesive used to secure the wall panel sections flush against the wall or tile surfaces of the bathtub recess or alcove, or to secure the dome 110 to the wall liner flanges 92, should be of a type which is not thermally sensitive, when used in steam environments. Thus, the installation may be adapted for use as a steam bath enclosure by the addition of a tub enclosure to the front open end of the alcove, and providing a steam generator for the enclosure. In this instance the adhesive insures an effective seal about the entire enclosure, with permanent adhesion since the adhesive will not be loosened by the steam.

While a preferred embodiment of the invention has been shown and described herein, it is obvious that numerous omissions, changes and additions may be made in such embodiment without departing from the spirit and scope of the invention.

What is claimed is:

1. Bathtub renovating means for refurbishing an existing bathtub installed in a wall recess and having a tub cavity and marginal ledges extending outwardly from the upper end of said tub cavity, said bathtub renovating means including a bathtub liner formed of a substantially flexible plastic material and comprising a tub portion having a bottom wall and upstanding side and end walls, and peripheral flanges extending perpendicularly outward from the top ends of said side and end walls, the tub portion of said bathtub liner being of lesser length and lesser width than the tub cavity of said bathtub, and being of a height greater than the depth of said tub cavity, whereby said bathtub liner is sized for insertion on said existing bathtub in a mounted position in which said tub portion of said liner is seated within the tub cavity of said bathtub with the bottom wall of said liner resting upon the bottom surface of said tub cavity, at least some of the side and end walls of said liner spaced from the corresponding side and end walls of the tub cavity, the peripheral flanges of said liner overlying the marginal ledges of said bathtub, and the weight of the bathtub liner supported substantially solely by the bottom surface of the cavity of said existing bathtub.

2. Bathtub renovating means according to claim 1 in which in the mounted position of said bathtub liner, said peripheral flanges of said liner are spaced above the marginal ledges of said existing bathtub.

3. Bathtub renovating means according to claim 1 in which in the mounted position of said bathtub liner, the side and end walls of said liner are spaced from the adjacent wall surfaces of said tub cavity to define gaps therebetween, said gaps being filled with a self-aligning fluent filler material.

4. Bathtub renovating means according to claim 3 in which said filler material is a fractionated material in granular form.

5. Bathtub renovating means according to claim 3 in which said filler material is a cellular plastic material.

6. Bathtub renovating means according to claim 3 in which said filler material is a highly filled epoxy resin.

7. Bathtub renovating means according to claim 1 in which said bathtub liner is formed from a sheet fiberglass reinforced polyester.

8. Bathtub renovating means according to claim 1 in which said bathtub liner is formed from acrylonitrile-butadiene-styrene in sheet form.

9. Bathtub renovating means according to claim 1 in which said bathtub liner is formed from a thermoplastic sheet having a fiberglass reinforced polyester layer adhesively attached to the outer surface thereof to reduce the flexibility of said bathtub liner, said outer layer lying against the surface of said existing bathtub.

10. Bathtub renovating means according to claim 1 which also includes a skirt extending from at least one of the flanges of said bathtub liner downwardly to the floor surface supporting said bathtub.

11. Bathtub renovating means according to claim 10 in which said skirt has a top flange projecting perpendicularly therefrom and secured to said bathtub liner flange.

12. Bathtub renovating means according to claim 1 which also includes sealing means between said bathtub liner and said wall recess, said sealing means comprising a flexible plastic membrane secured at one side to at least one surface of each bathtub ledge facing a wall of said recess, and at the other side to the adjacent recess wall.

13. Bathtub renovating means according to claim 1 in which said wall recess includes a side wall and a pair of opposed end walls and which also includes a wall liner assembly for covering the side and end walls of said wall recess above said bathtub liner, said wall liner assembly being made of plastic sheet material.

14. Bathtub renovating means according to claim 13 in which said wall liner assembly includes a central section comprising a panel secured flush against the center of said side wall of said wall recess, and a pair of L-shaped side sections, each of said side sections having a first panel secured flush against an end wall of said recess and a second panel disposed perpendicularly to said first panel and secured flush against the side wall of said recess.

15. Bathtub renovating means according to claim 14 in which each of said liner assembly sections has a top flange disposed perpendicularly thereof and extending outwardly from the recess wall on which said section is mounted, said wall liner assembly also including a dome overlying said bathtub liner and having marginal edge portions overlying said top flanges and supported thereby.

16. Bathtub renovating means according to claim 15 in which said wall section panels and said dome as formed from thermoplastic sheets having a fiberglass reinforced polyester layer adhesively attached to the outer surface thereof to reduce the flexibility of said sheets.

* * * * *

Dedication 4,067,071.—*Murray Altman,* Scarsdale, *Richard Altman,* Bardonia, and *Arthur Roberts,* Westbury, N.Y. BATHTUB, WALL AND CEILING LINER ASSEMBLY. Patent dated Jan. 10, 1978. Dedication filed Feb. 2, 1981, by the assignee, *Thermasol, Ltd.*

Hereby dedicates to the Public the entire term of said patent.

[*Official Gazette November 17, 1981.*]